US005785567A

United States Patent [19]

Modugno

[11] Patent Number: 5,785,567

[45] Date of Patent: Jul. 28, 1998

[54] BUOYANCY JACKET

[76] Inventor: John L. Modugno, 1571 W. 211th St., Torrance, Calif. 90501

[21] Appl. No.: 768,326

[22] Filed: Dec. 17, 1996

[51] Int. Cl.[6] ..... B63C 9/16

[52] U.S. Cl. ..... 441/88; 441/90

[58] Field of Search ..... 441/88, 102–119, 441/92, 91, 90; 405/186

[56] References Cited

U.S. PATENT DOCUMENTS

| | | | |
|---|---|---|---|
| 2,550,562 | 4/1951 | Hurt et al. | 441/116 |
| 4,561,853 | 12/1985 | Faulconer et al. | 441/146 |
| 4,685,890 | 8/1987 | Edwards | 441/92 |
| 4,865,573 | 9/1989 | Switlik, Jr. et al. | 441/92 |
| 5,067,921 | 11/1991 | Bramham | 441/90 |

*Primary Examiner*—Ed L. Swinehart
*Attorney, Agent, or Firm*—Matthew P. Lynch

[57] ABSTRACT

The subject invention is a buoyancy jacket constructed of a pair of separate buoyancy compartments overlying each other. There is an inner buoyancy compartment and an outer buoyancy compartment with the inner buoyancy compartment to be located directly adjacent the skin of the wearer of the jacket. Each of the buoyancy compartments are to be inflated by a separate inflation valve. The body of the jacket includes a plurality of baffles with each baffle including a small loop of sheet material. Each loop is to be fixedly connected between the outer layer of the jacket and the intermediate layer, and also between the inner layer of the jacket and the intermediate layer. It is the function of the loops to limit the expansion of the buoyancy compartments when inflated.

1 Claim, 1 Drawing Sheet

BUOYANCY JACKET

BACKGROUND OF THE INVENTION

1). Field of the Invention

The field of this invention relates to buoyancy jackets which are to be worn by underwater divers.

2). Brief Description of the Prior Art

A buoyancy jacket that is used by underwater divers has long been known. A typical buoyancy jacket will be constructed of a single inflating compartment with this compartment to be inflated by an inflation valve. The amount of inflation of the jacket can be varied according to the amount of air that is supplied within the single inflating compartment. It is the function of the buoyancy jacket to contain just the right amount of air within the inflating compartment so that the diver will have neutral buoyancy within the water.

The main disadvantage to buoyancy jackets of the prior art is that there is a single buoyancy chamber. It is common that buoyancy jackets are constructed of a fabric or a fabric-like material. The diver infrequently incurs a jacket damaging situation such as a sharp rock or a piece of metal within a shipwreck. Upon the jacket encountering such a damaging situation, it can be ripped which results in the inflating chamber being deflated. The neutral buoyancy of the diver would now no longer exist. This means that the diver will now have to propel himself or herself in an upward direction toward the surface of the water in order to keep from sinking.

SUMMARY OF THE INVENTION

The primary objective of the present invention is to construct a buoyancy jacket that has redundant buoyancy compartments so that in the event that a single buoyancy compartment is deflated there is a second buoyancy compartment that is still operating and can be used to make the buoyancy neutral of the diver who is wearing the buoyancy jacket.

The buoyancy jacket of the present invention is constructed of a body which is to be wrapped around the torso of the human user. The body is constructed of three different fluid impervious layers which are located in juxtaposition. The peripheral edges of the impervious layers are secured together thereby creating an inner buoyancy compartment and an outer buoyancy compartment. The inner buoyancy compartment is designed to be located directly adjacent the skin of the wearer with the outer buoyancy compartment designed to be located directly adjacent the ambient. Separate air inflation valves are connected to each compartment with these air inflation valves to be manually operable both above the surface of the water and below the surface of the water. Throughout the body of the jacket there are located a plurality of baffles. Each baffle comprises a small loop of material which is secured between the outer layer of material of the jacket and the intermediate layer of the jacket, as well as between the inner layer of the jacket and the intermediate layer of the jacket. It is the function of the loops of material to limit the amount of expansion of each buoyancy compartment.

DETAILED DESCRIPTION OF THE PREFERRED EMBODIMENT

Figures 1, 2, 3, 4:
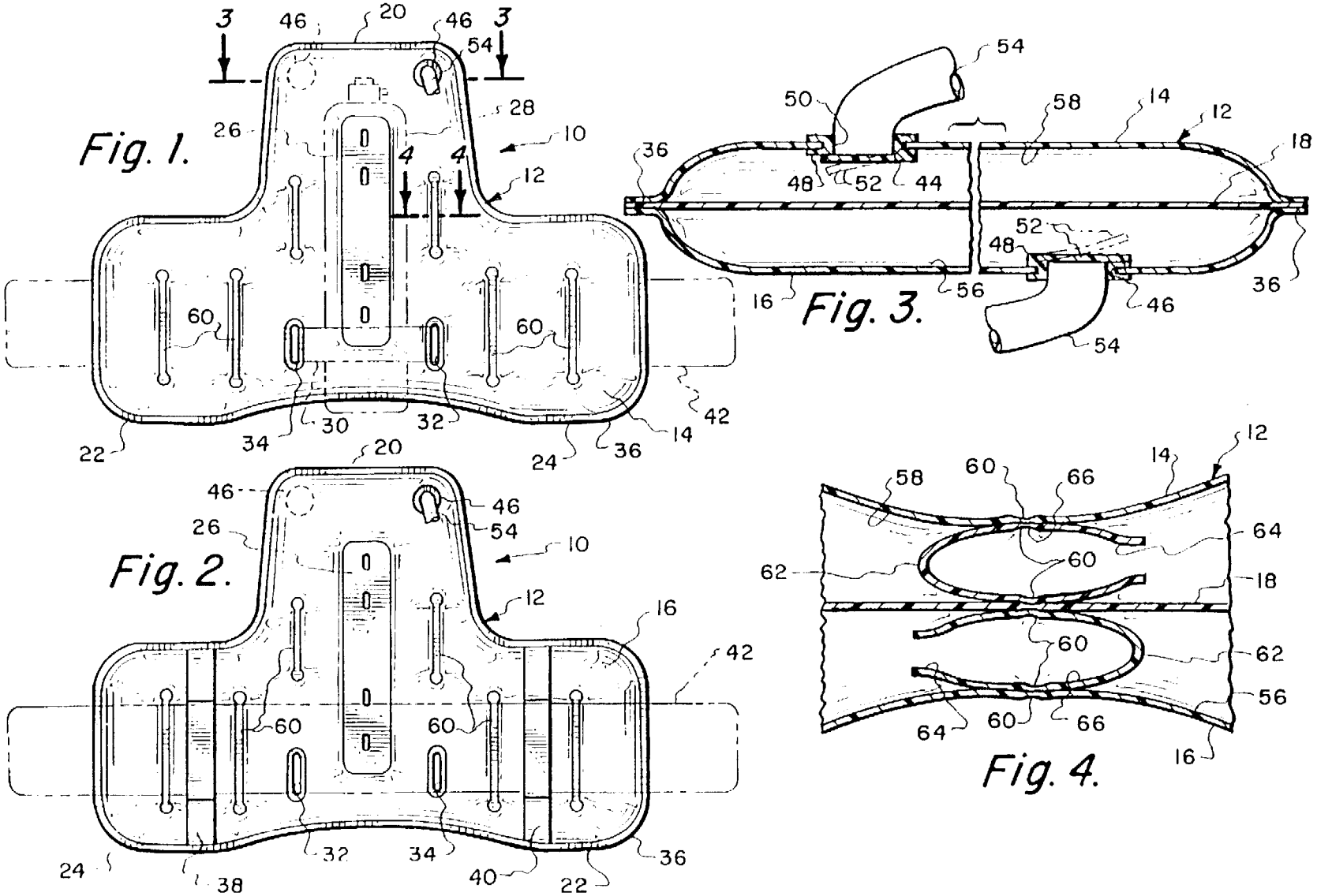
FIG. 1 is an exterior view of the buoyancy jacket of the present invention constructed in accordance with this invention showing the outside of the buoyancy jacket in an expanded or flattened configuration and not mounted on the body of the human.
FIG. 2 is an exterior view of the inside of the buoyancy jacket of the present invention similar to FIG. 1.
FIG. 3 is a cross-sectional view taken along line 3—3 of FIG. 1 showing in more detail the inflation valves that are utilized in conjunction with the buoyancy jacket of the present invention.
FIG. 4 is a cross-sectional view taken through one of the baffles included within the buoyancy jacket of the present invention taken along line 4—4 of FIG. 1.

Referring particularly to the drawing, there is shown the buoyancy jacket 10 of this invention which is composed generally of a body 12. The body 12 is composed of an outer layer 14 and an inner layer 16. Both the outer layer 14 and the inner layer 16 are constructed of the same material which generally will be of a rubberized plastic material. Located between the outer layer 14 and the inner layer 16 is an intermediate layer 18. The intermediate layer 18 would generally also be constructed of a plastic type of material. The layers 14, 16 and 18 are all flexible and basically resemble a fabric type of material. The layers 14, 16 and 18 are all impervious to any fluid such as air and water. The size of the layers 14, 16 and 18 are all identical. The layers 14, 16 and 18 are constructed to be of a shape so that when it is wrapped around the torso of a human being the enlarged center section 20 will be located against the back of the wearer and the wings 22 and 24 will be located against the front of the torso of the wearer. The jacket 10 is to include an appropriate securement area 26 which facilitates connection with an air tank 28. A strap 30 is to be conducted through strap openings 32 and 34 to strap down the air tank 28 to the securement area 26. The layers 14, 16 and 18 are all secured at a peripheral edge 36. The securement at the peripheral edge 36 is to be airtight.

Mounted on the inner layer 16 is a pair of straps with one strap 38 being mounted on the wing 24 with the second strap 40 being mounted on the wing 22. The straps 38 and 40 are to facilitate connection with a cummerbund 42 which is to be used to tightly bind the body 12 onto the body of the wearer. The inner layer 16 is to be located directly adjacent the body of the wearer with generally a wet suit covering the body of the wearer. It is to be understood that the inner layer 16 will be located directly against the wet suit.

The outer layer 14 includes a hole 44. A similar hole 46 is formed within the inner layer 16. Mounted within the hole 44 is a washer-type disc 48 with a similar type of washer-type disc 48 being mounted within the hole 46. Each washer-type disc 48 includes a center opening 50. This center opening 50 is normally closed on its inside surface by means of a rubber flap valve 52. A conduit in the form of a flexible tube 54 is tightly secured to the disc 48 and connects with the opening 50. The user can place the outer end of the tube 54 within the user's mouth and by blowing into the tube 54 unseat the flapper valve 52 causing air to be moved within inner compartment 56 or outer compartment 58. Of course it is to be understood that the inflation of each of the compartments 56 and 58 is to be achieved separately and only upon blowing of air through the tube 54 that connects with the respective compartment 56 or 58. The compartments 56 and 58 can be inflated partially or in total with the inflation between the compartments 56 and 58 being being approximately the same or substantially different. During diving if the outer layer 14 becomes torn causing the outer compartment 58 to lose its air pressure, there would still be available the compartment 56 to be used by the diver to achieve substantially neutral buoyancy.

During inflation of the compartments 56 and 58 the body 12 would be expanded to be essentially the shape of a balloon unless some means was employed to prevent this expansion. The desirable form of the means to be employed is a series of baffles which includes necked down sealing areas 60. These sealing areas 60 are formed within each of the layers 14 and 16. There are actually shown six in number of the baffles within layers 14 and 16 with it being understood that the number of these baffles could be increased or decreased. Each baffle includes a loop 62 of a fabric type of material. There is to be a loop 62 secured to the layer 16 directly adjacent the necked down area 60 with there being a second loop 62 fixedly secured adjacent each necked down area 60 formed within the outer layer 14. The loops 62 are also fixedly secured to the intermediate layer 18. The size of the loops 62 will determine the amount of expansion of the compartments 56 and 58. It is the function of the loops 62 to limit this expansion. Each of the loops 62 includes a hole 64. It is the function of the hole 64 to permit air to enter the interior compartment 66 of the loop 62 if per chance the loop 62 has closed ends. It is desirable that the air pressure within each of the loops 62 be identical to the air pressure contained within the compartments 56 and 58.

What is claimed is:

1. A buoyancy jacket comprising:

a body adapted to be wrapped around the torso of a human, said body being constructed of a plurality of layers defined as an inner layer and an outer layer, an intermediate layer located between said inner layer and said outer layer with said intermediate layer comprising a single strip of material, said layers are to be flexible, said layers being impervious to fluid, said inner layer adapted to be located directly adjacent the skin of the wearer, said outer layer to be directly exposed to the ambient;

an inner buoyancy compartment formed between said inner layer and said intermediate layer;

an outer buoyancy compartment formed between said outer layer and said intermediate layer, said outer buoyancy compartment being separate from said inner buoyancy compartment;

a first inflation valve connecting with said outer buoyancy compartment, a second inflation valve connecting with said inner buoyancy compartment, whereby said first and second inflation valves are to be separately manually used to inflate and deflate said compartments;

said body including a plurality of baffles, each said baffle limiting the expansion of said inner buoyancy compartment and said outer buoyancy compartment when such are inflated; and each said baffle including a small loop of sheet material connected between said inner layer to said intermediate layer and a small loop of sheet material connected between said outer layer and said intermediate layer, whereby said small loops of sheet material limit the expansion of said inner buoyancy compartment and said outer buoyancy compartment during inflation of said compartments.

* * * * *